United States Patent [19]

Govan

[11] Patent Number: 5,052,957

[45] Date of Patent: Oct. 1, 1991

[54] SUPPORT FOR LINE AND WEED CUTTER

[76] Inventor: Donald T. Govan, Box 350246, Fort Lauderdale, Fla. 33335

[21] Appl. No.: 608,983

[22] Filed: Dec. 7, 1990

Related U.S. Application Data

[63] Continuation-in-part of Ser. No. 550,896, Jul. 11, 1990, Pat. No. 5,017,167.

[51] Int. Cl.[5] ..... B63H 5/12

[52] U.S. Cl. ..... 440/73; 440/71; 416/146 R

[58] Field of Search ..... 440/71, 73, 900; 416/146 R, 146 B

[56] References Cited

U.S. PATENT DOCUMENTS

| | | | |
|---|---|---|---|
| 4,447,215 | 5/1984 | Govan | 446/73 X |
| 4,722,667 | 2/1988 | Rikhy et al. | 440/73 X |
| 4,927,213 | 5/1990 | Burgdore | 303/116 |
| 4,986,612 | 1/1991 | Arikawa | 180/197 X |

*Primary Examiner*—Ed Swinehart

*Attorney, Agent, or Firm*—Alvin S. Blum

[57] ABSTRACT

Apparatus shears foreign matter such as lines, wires, nets and weeds that can entangle and befoul propellers, propeller shafts, bearings and related structures of propeller-driven, water born vessels. The apparatus shears by cooperative action of a rotating blade that rotates in conjunction with the propeller and a non-rotating blade supported on a non-rotating portion of the vessel. The non-rotating blade is supported on a rope guard that encircles the shaft. A system for simplified installation and alignment includes an intermediate box that supports the non-rotating blade. This assembly is temporarily clamped to a rotating blade, with the box passing through an aperture in the rope guard. Then the box is welded to the rope guard at the aperture.

9 Claims, 2 Drawing Sheets

SUPPORT FOR LINE AND WEED CUTTER

This application is a continuation-in-part of copending application Ser. No. 07/550,896 filed 7/11/90, now U.S. Pat. No. 5,017,167.

BACKGROUND OF THE INVENTION

Field of the Invention

This invention relates to marine devices that cut lines, nets, weeds and the like, and more particularly to supports for shearing cutters that employ a blade rotating with the propeller of a vessel that cooperates with a non-rotating blade mounted on a rope guard of a vessel adjacent the shaft.

Lines, nets, weeds and the like are commonly encountered by vessels. They may be swept by the propeller blades into the propeller shaft apparatus where they can cause great harm, i.e. into the space where the propeller shaft extends from its housing. There they cut through the oil seals causing loss of lubricant. The current trend toward long line fishing wherein heavy monofilament nylon many miles long is lying in the water has exacerbated the problem. Applicant's U.S. Pat. No. 4,943,249 which issued on 7/24/90 teaches a unique means for adjusting the distance between a pair of radially extending shearing cutters, one of which is attached to a non-rotating portion of the ship and one of which is attached to a rotating portion of the ship.

The position of the propeller will change relative to the hull, advancing axially when under way in forward due to the forward thrust of the propeller. Heating and cooling of the shaft will also change propeller axial position. A sensing mechanism senses propeller location and a moving mechanism moves the non-rotating blade to accomodate these changes in relative propeller location to maintain a fixed, very close spacing between the two blades for effective shearing action.

U.S. Pat. Nos. 4,447,215; 4,507,091; 4,544,363 and 4,801,281 issued to Applicant disclose means for mounting both rotating and non-rotating shearing blades on the shaft so that axial shaft displacement has no effect on relative blade spacing. A simple, inexpensive mechanism for maintaining the correct distance between a rotating blade on a shaft or propeller and a non-rotating blade mounted on a non-rotating portion of the ship for optimum shearing action between the two blades despite axial movement of the shaft and propeller would be useful for many waterborne craft.

Prior art devices mount the non-rotating member of a line shearing system to the strut or shaft bearing housing of the vessel. There are situations where this support means may not be effective or may complicate correct installation.

SUMMARY OF THE INVENTION

It is accordingly an object of the invention to provide a shearing cutter system in which a non-rotating blade mounted on a non-rotating portion of a vessel cooperates with one or more rotating blades that includes means for maintaining an optimal spacing between blades for effective shearing action to overcome axial movement of the rotating elements. The system includes a non-rotating blade that has a shearing plane perpendicular to the axis of rotation of the shaft. This blade rides in a blade holder that permits limited axial movement of the blade. The blade holder mounts on the rope guard that surrounds the rotary shaft and its bearing. One or more rotating blades are mounted on the propeller with a shearing plane parallel to the non-rotating blade. The shearing planes of the two blades must be very close together for effective cutting. To ensure optimal axial positioning of the two blades, the rotating blade carries along with it a positioning groove or slot. The non-rotating blade carries a slot follower with tapered leading and following edges. As the slot encounters a tapered edge of the slot follower during its rotation, the slot follower and its blade are moved axially until the slot follower fits into the slot, thereby moving the two blades into the blade spacing necessary for optimal shearing action. Damping means are provided to slow the axial movement to avoid excessive axial movement between revolutions from the thrust of the moving water. Means are also provided for resisting forces that tend to spread the blade apart when a foreign object is being sheared by the blades.

The line cutters of the prior art that carry the non-rotating blade on a blade carrier attached to the shaft require a special blade and blade carrier for each shaft diameter. Furthermore, since the carrier is continuously rotating and the blade is not, a bearing between the two is subject to considerable wear and damage, requiring periodic replacement. The instant invention can be installed on a variety of shaft diameters, and it overcomes the bearing problem because the slot follower is only briefly in the slot during each revolution. Mounting the blade holder on the rope guard that surrounds the shaft bearing and the shaft facilitates correct assembly with proper spacing and alignment of the rotating and non-rotating blades.

Alternative embodiments of the invention include use for supporting the non-rotating blade of an assembly with other means of maintaining correct spacing of the rotating and non-rotating blades such as that disclosed in U.S. Pat. No. 4,943,249 issued 7/24/90 to the applicant incorporated herein by reference.

These and other objects, features and advantages of the invention will become more apparent when the detailed description is studied in conjunction with the drawings.

DETAILED DESCRIPTION OF PREFERRED EMBODIMENTS

Figure 2:
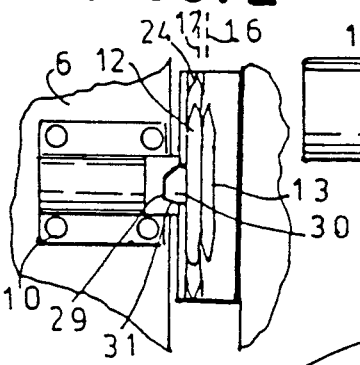
FIG. 2 is a top view of the apparatus of FIG. 1.
Figure 3:
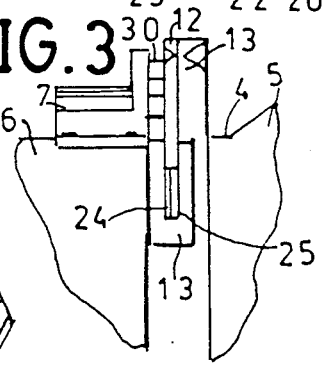
FIG. 3 is a side elevation view of the apparatus of FIG. 1.
Figure 1:
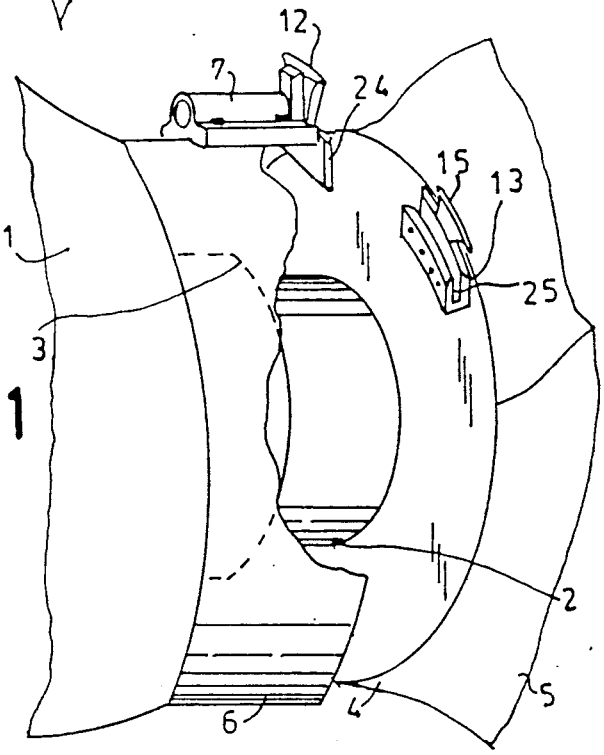
FIG. 1 is a perspective view, partially broken away, of the apparatus of the invention installed on a vessel.

Referring now first to FIGS. 1-3, a vessel 1 has a propeller shaft 2 journalled within a propeller shaft housing 3 with a propeller hub 4 carrying propeller 5 affixed to the shaft. A rope guard 6 surrounds the shaft and is fixed to the vessel. A support block 7 for supporting the non-rotating blade 12 is bolted to the rope guard 6 in correct position for cooperating with the rotating blade assembly 13.

Figure 13:
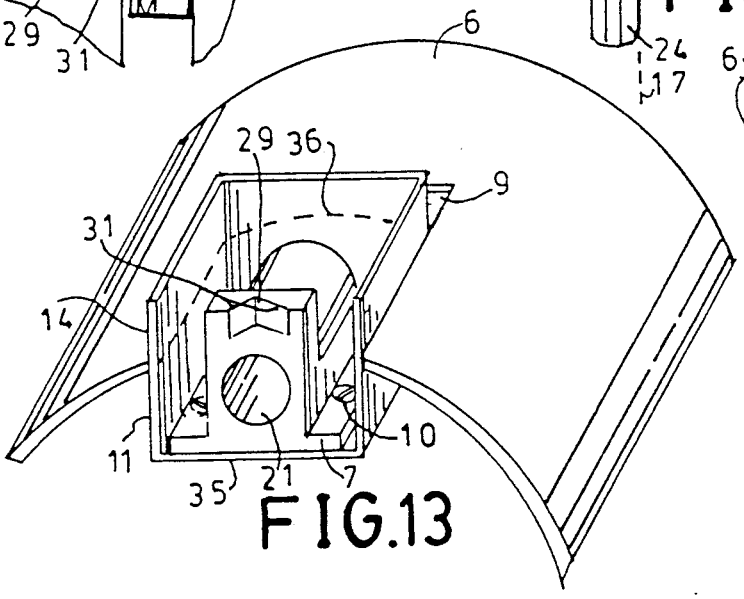
FIG. 13 is a perspective view of a box member in position in an aperture cut in a rope guard for holding the support block in correct position.

Alternatively, as shown in FIG. 13, an aperture 9 is cut in rope guard 6. The support block 7 is bolted by bolts 10 to the floor 35 of a box member 11. The box member is adjusted to correct position relative to the rotating blade assembly 13 and welded to the rope guard 6 by the paralle sides 14, and projecting portions cut off at line 36. This provides wider latitude in adjustment to suit a greater variety of installations with fewer sizes of apparatus. The rotary blade assembly 13 is bolted to the propeller hub 4 so that the rotary blade 15 extends radially beyond the hub 4, with its shear plane 16 perpendicular to the axis of shaft 2. This positions the blade 15 so that it catches foreign matter as it turns and twists it inward where it will be caught and sheared against the non-rotating blade 12. Blade 12 is held radially extended with its shearing plane 17 parallel to the shearing plane 16 of the rotary blade 15 by the support block 7. For most effective shearing by the two blades' shearing edges 34, the two shearing planes are best spaced apart a distance of approximately 0.005 inches according to current observations.

During operation of the vessel, various forces are at work that tend to move the propeller axially relative to the supporting structures holding the non-rotating blade 12. These forces include thrust of the propeller blades against the water and expansion and contraction from heating and cooling. In order to maintain optimum spacing of the two blades when the rotating blade is moved axially by these forces, the non-rotating blade supported by the fixed support block must move axially by a corresponding amount.

Figure 9:
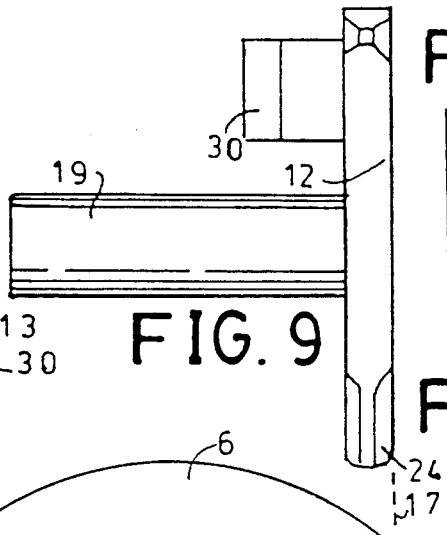
FIG. 9 is a side elevation view of the non-rotating blade.
Figure 11:
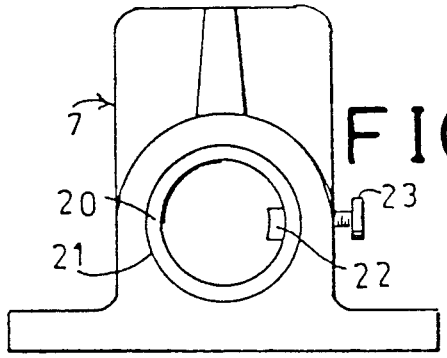
FIG. 11 is a rear elevation view of the support block.
Figure 5:
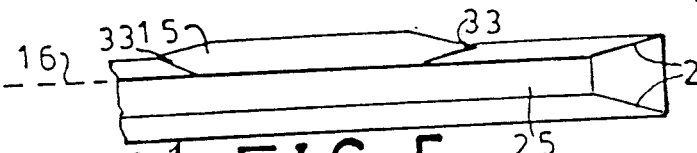
FIG. 5 is a top view, partially broken away, of the rotating blade.
Figure 6:
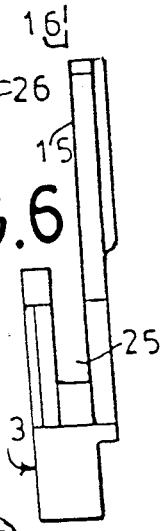
FIG. 6 is a side elevation view of the rotating blade.
Figure 4:
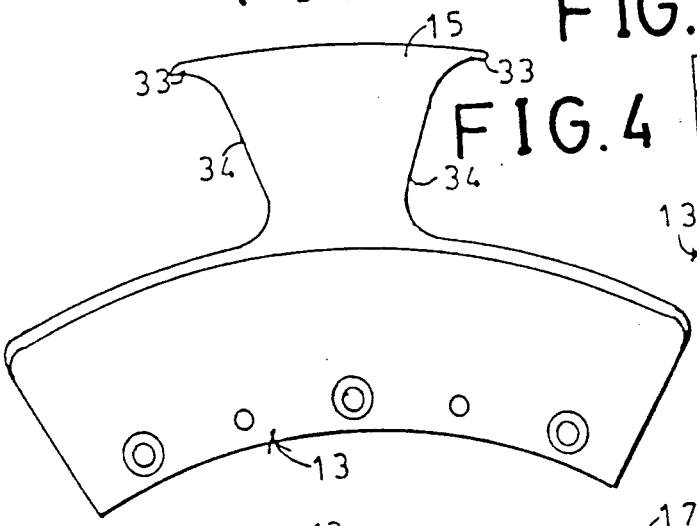
FIG. 4 is a front elevation view of the rotating blade.

The axial movement of blade 12 within support block 7 is provided by cylinder 19 extending from blade 12, as best seen in FIG. 9, which slides axially within lubricous sleeve bearing 20 fixed in axial hole 21 in support block 7, as best seen in FIG. 11.

Figure 10:
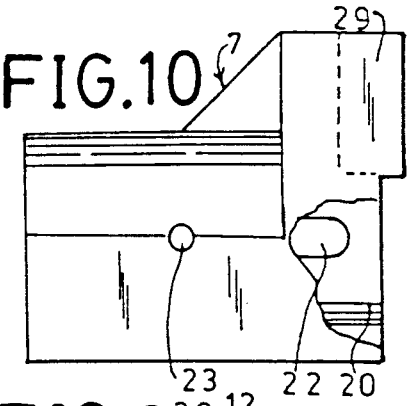
FIG. 10 is a side elevation view of the support block, partially broken away.

As best seen in FIGS. 10 and 11, an elongate segment 22 of the sleeve bearing 20 is free to move radially within an aperture in the bearing 20. Bolts 23 threadably engaged in block 7 are forced against segment 22 to press in against cylinder 19 of blade 12 to apply an adjustable clamping force on the cylinder. This controllably restricts both axial and pivotal motion of cylinder 19 in the support block 7.

The primary control mechanism for maintaining optimum spacing between the two blades is provided by the slot follower 24 connected to blade 12 that fits within slot 25 connected to rotary blade assembly 13. As best seen in FIGS. 1-3, with every propeller revolution, the beveled leading edge 26 of the slot 25 encounters the tapered leading edge 27 of the slot follower 24, and the non-rotating blade 12 is moved axially under the inclined plane forces until the slot follower fits into the slot. The damping effects of the clamping plate 22 prevents the blade 12 from moving between revolutions so that there are relatively small forces between slot and slot follower during most revolutions. When the propeller does move axially, then the slot follower moves blade 12 correspondingly.

Figure 8:
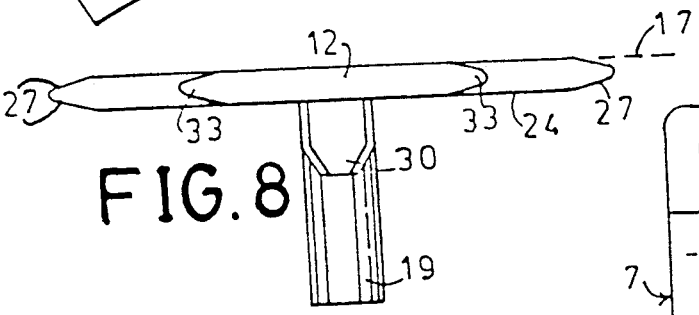
FIG. 8 is a top view of the non-rotating blade.
Figure 7:
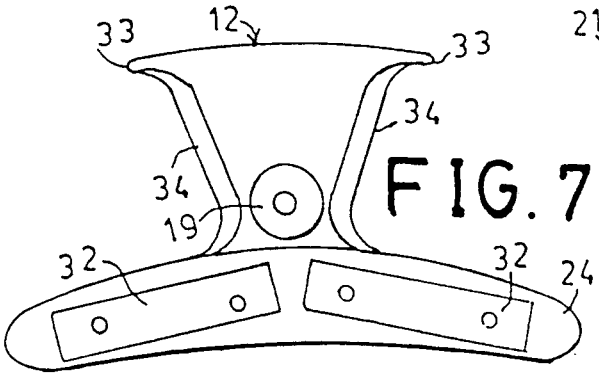
FIG. 7 is a front elevation view of the non-rotating blade.
Figure 12:
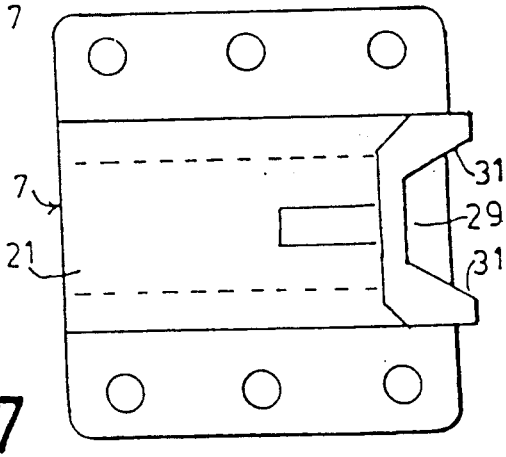
FIG. 12 is a top view of the support block.

As best seen in FIGS. 7 and 8, the slot follower is provided with lubricous bearing plates 32 to reduce friction and wear.

When cutting a heavy cord with a scissors, there is a tendency for the blades to be forced apart. If this happens, the shearing action of the blades is lost. The blades of the instant invention are prevented from being forced apart by the slot follower engaging the slot before the shearing edges 34 of the blades come into shearing alignment. A wedge and valley mechanism is also provided to maintain blade spacing during shearing. As best seen in FIGS. 2, 8, 9, 12 and 13, the support block 7 has a valley 29 with sloping sides 31. The non-rotating blade 12 is provided with a wedge-shaped projection 30 that fits within the valley 29. When torque is generated by the shearing action, the blade cylinder 19 tends to pivot within the bearing sleeve 20 in the support block. This forces the wedge 30 against one of the sloping sides 31 of the valley. The inclined plane action produces a force vector pushing blade 12 against blade 15. This counteracts the tendency of foreign matter to force the blades apart during shearing.

As best seen in FIGS. 4, 5, 7 and 8, at the radial limits of both blades a projection 33 extends beyond each of the shearing edges 34. Each projection 33 is tapered at its leading edge. These tapered projections or ramps are provided as a means of ensuring that the shearing edges will never strike one another as they pass due to inadvertent malpositioning such as blade vibration. If the blade should be malpositioned such that the two shearing edges would touch each other, the tapered ramps 33 would meet each other before that could happen and force the blades apart.

An effective installation procedure is as follows: Aperture 9 is cut in the rope guard 6. Rotating blade assembly 13 is installed on the propeller 5. Support block 7 is bolted to box member 11 and non-rotating blade assembly 12 is inserted in block 7. Then the blades 12 and 15 are temporarily fastened together by clamps, bolts and the like with a shim spacer between to get exact positioning of blade 12, block 7 and box 11 relative to blade 15. While held in this position, box 11 is welded to the rope guard 6 for permanent installation.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. An apparatus that cuts foreign matter including lines, wires, nets and weeds of the type that may be encountered by propeller driven vessels when under way, said vessels having the propeller mounted to a rotatable propeller shaft that extends from a propeller shaft housing connected to the vessel's hull, said apparatus having:

A) at least one first blade means for cutting, said first blade means having a first shearing plane, said first blade means arranged to rotate in conjunction with said propeller with said first shearing plane substantially perpendicular to the axis of said shaft;

B) first support means for supporting said first blade means in position extending radially and beyond said first support means to engage said foreign matter, said first support means including means for fixedly attaching to at least one member of the pair consisting of said shaft and said propeller;

C) at least one second blade means for cutting, said second blade means having a second shearing plane, said second blade means arranged with said second shearing plane substantially parallel to said first shearing plane of said first blade means;

D) second support means for supporting said second blade means in a position extending radially parallel to said first blade means to engage said foreign matter for shearing said foreign matter between said first and second blade means, in which the improvement comprises: attaching means for attaching said second support means to a rope guard member fixedly connected to said hull, in which said rope guard member encircles said shaft and said shaft housing and is spaced apart radially therefrom.

2. The apparatus according to claim 1, in which said attaching means includes an intermediate member having means for rigidly affixing said second support means thereto, said intermediate member provided with fastening means for rigidly fastening to said rope guard member.

3. The apparatus according to claim 2, in which said fastening means is arranged for fastening said intermediate member to said rope guard member after said second support means has been affixed to said intermediate member to facilitate installation.

4. The apparatus according to claim 3, in which said fastening means is welding.

5. The apparatus according to claim 3, in which said intermediate member is arranged to be received in an aperture in said rope guard means and said fastening means fastens to at least one margin of said aperture to facilitate radial and axial positioning of said second support means relative to said first blade means.

6. The apparatus according to claim 5, whereby said second blade means, while mounted in said second support means may be axially and radially adjusted relative to said first blade means and removably attached thereto while said second support means is affixed to said intermediate member before said intermediate member is fastened to said rope guard member.

7. Apparatus according to claim 6, in which said fastening means is welding.

8. In a system for cutting foreign matter that may be encountered by a vessel driven by a propeller mounted on a propeller shaft that is rotatably journalled in a shaft housing that includes a rotating first blade arranged to rotate with the propeller and having a shearing plane perpendicular to the axis of the shaft and a non-rotating second blade, a method of installation of said second blade that facilitates axial and radial alignment of the second blade relative to the first blade with the shearing plane of the second blade parallel to and adjacent said shearing plane of said first blade for enhanced cooperation therewith, said method comprising:

A) mounting said second blade in a blade support element;

B) providing a rope guard member encircling said propeller shaft housing and spaced apart radially therefrom;

C) providing an aperture in said rope guard member to receive said blade support element, said aperture providing free radial movement of said support element therein;

D) releasably attaching by attachment means said second blade to said first blade in operative alignment of said shearing planes while said second blade is mounted in said support element and said support element is received in said aperture;

E) affixing said support element to said rope guard member while said blades are in said operative alignment; and F) releasing said attachment means.

9. The method according to claim 8, in which said support element is connected to an intermediate member and said intermediate member is then affixed to said rope guard member.

* * * * *